US005242220A

United States Patent [19]

Sandreth

[11] Patent Number: 5,242,220

[45] Date of Patent: Sep. 7, 1993

[54] TRASH CLASSIFICATION APPLIANCE

[76] Inventor: Sherry D. Sandreth, 28 Live Oak La., Hickory Creek, Tex. 75065

[21] Appl. No.: 711,855

[22] Filed: Jun. 7, 1991

[51] Int. Cl.[5] ..... A47B 88/00

[52] U.S. Cl. ..... 312/311; 312/296; 220/404; 220/529; 220/909

[58] Field of Search ..... 312/296, 311, 270.1, 312/270.3, 291; 220/404, 523, 529, 554, 909

[56] References Cited

U.S. PATENT DOCUMENTS 1,281,587 10/1918 Kovachevich .
2,345,271 3/1944 Loftin et al. ..... 312/296 X
2,625,973 1/1953 Weldon et al. .
3,528,718 9/1970 Johnson et al. ..... 312/270.3 X
3,648,875 3/1972 Lundgren .
3,807,299 4/1974 Engebretsen .
3,893,615 7/1975 Johnson .
3,917,107 11/1975 Bottas et al. .
4,729,489 3/1988 Papaianni .
4,821,903 4/1989 Hayes .
4,834,262 5/1987 Reed .
4,874,111 10/1989 Heller .
4,893,719 1/1990 Lombardi et al. .
4,940,159 7/1990 Callas et al. .
4,941,653 7/1990 Sterner, Jr. ..... 220/909 X
5,072,852 12/1991 Smith et al. ..... 220/909 X

*Primary Examiner*—James R. Brittain
*Assistant Examiner*—Brian K. Green
*Attorney, Agent, or Firm*—John F. Bryan, Jr.

[57] ABSTRACT

An appliance for facilitating the sorting and handling of household trash as an aid to recycling such materials includes a housing with a plurality of vertically arrayed compartments containing horizontally disposed flexible bags with open ends extending through a separately covered access hole in each compartment front panel. Supporting slide mechanisms allow each compartment to be pulled out of the housing for unloading and alternate compartment configurations provide for the handling of waste newspaper or the inclusion of a trash compactor.

14 Claims, 5 Drawing Sheets

TRASH CLASSIFICATION APPLIANCE

TECHNICAL FIELD OF THE INVENTION

The present invention relates generally to the field of refuse containers, particularly to compartmentalized containers for classifying trash for recycling, and more specifically to such containers wherein the individual compartments have removable liners that are horizontally rather than vertically disposed.

BACKGROUND OF THE INVENTION

Compartmentalized trash containers are well known to the art, and have been disclosed in various embodiments utilizing the ubiquitous trash bag as a disposable liner. Pertinent examples of this art are found in Johnson, U.S. Pat. No. 3,893,615; Reed, U.S. Pat. No. 4,834,262; and Heller, U.S. Pat. No. 4,874,111. Each of these disclose a compartmented housing for separate bag liners used for receiving and disposing of trash. Heller, '111, and Reed '262 both acknowledge the thrust of waste material recycling, and all three disclose means for holding the bags vertically and gripping the bags at the open top. Johnson, '615 discloses means for removing the filled bags from a side opening in the compartment, and both Johnson and Heller teach separate doors covering each compartment.

The advent of widespread environmental concern is focusing attention on the universal need for recycling of materials, and certainly, the household is an area of primary importance in this regard. We are beginning to see municipal refuse collection systems which emphasize classification for recycling, and such programs are almost certain to become the rule rather than the exception. These programs will be structured in various ways, some requiring the trash to be put out in labeled bags for collection, others furnishing separate containers for each material classification and local variations of both methods. Some systems may relay on sorting at a transfer station, but this approach is costly and labor intensive, making presorted collection the preferred option.

Since efficient material recycling dictates individual involvement and effort, the coming need to facilitate an environmentally aware lifestyle is evident. The ideal approach is perceived to be that of integrating the procedures of trash classification into the daily routine so that it becomes as natural and effortless as possible, thereby encouraging maximum participation.

Most recycling programs require separation of refuse into at least four classes; aluminum cans, glass, paper and waste. Comprehensive recycling might add other classifications such as, plastics, ferrous materials and compostables to this list. Furthermore, in order to minimize handling, the classification device must be in the kitchen, where most waste originates, and must be large enough to hold refuse from one collection day to the next. The inclusion of a compactor, particularly in situations where fewer classifications are required, would complete the capabilities of the ideal refuse recycling appliance. Prior art does not disclose a method or device having such capabilities from a practical point of view. In kitchens made small to enhance working convenience, size and ease of use are limitations inherent to the prior art. A prior art compartment group of useful size takes up more floor space than the average kitchen can spare. Size can be minimized at the expense of capacity, but then convenience suffers from rehandling.

Lifting out the filled bags is a physical problem for some, not only because of weight, but also because packing of the contents presses against the container walls to cause frictional forces, and possibly suction forces, that resist withdrawal.

SUMMARY OF THE INVENTION

A first object of the present invention is to allow separation of refuse into as many classes as needed for comprehensive recycling.

A second object is to promote convenience of use and to minimize the rehandling of classified refuse.

A third object is to provide an adequate capacity of classified material in a form suitable for use in a confined kitchen area.

A fourth object is to promote ease of use, including minimizing the physical effort required to remove bags of classified refuse for collection.

A fifth object is to provide means for inclusion of a compactor if desired.

To achieve these ends, the present invention orients the separate compartments horizontally, and stacks them so that minimal floor space is occupied by the grouping. A reusable bag or a disposable plastic bag is contained in each compartment with its closed end opposed to its open end on a substantially horizontal axis, and is supported by the bottom panel thereof. The open end of the bag extends through, and is restrained around, an access opening in a vertical front panel. Preferably, this front opening is smaller than the cross sectional dimensions of the bag, and is set above the elevation of the supporting bottom so as to retain items thrust into the bag. In the preferred embodiment, the compartment bottom and front panel are set on slides, much as is a file cabinet drawer, so that each compartment can be pulled out individually on a horizontal axis for removal of the bag. The side and rear edges of the bottom panel are turned up to form a tray to hold the bag in place so as not to foul the slide mechanism and contain any leakage from a tear or puncture. The multiple front panels of a preferred embodiment are covered by a single hinged outer door which has a preferably resilient inner facing to bear against the edges of the bag opening and may include an individual access cover for each compartment. Newspaper and the like, which may be bundled rather than bagged, is a major portion of a typical refuse mix, and an alternative compartment specifically adapted for bundling may be provided. This compartment is not covered by the outer door and is pulled out to receive, as well as discharge its contents. The bottom panel of this compartment may be grooved to facilitate placement of cordage under the paper for bundling and means may be provided for prepositioning such cordage for tying up the bundles.

A trash compactor may be more desirable when fewer classifications are sorted which consequently increases the amount of waste. In such cases, a compactor, as for example disclosed by Engebretsen in U.S. Pat. No. 3,807,299, may be included in a second alternative compartment having a separate hinged door.

The contents do not settle and pack against the compartment walls in the horizontal, unconfined bag of the present invention as is the case with vertically filled bags, and no lifting is involved in bag removal. The use of drawstring closure bags is preferred and, when the bags are ready for pick-up, the hinged outer door is opened to allowing the drawstrings to be pulled tight and tied at the front panel access hole. Then, each compartment in turn is pulled out and the bag rolled off, over the side edge, to be put out for collection.

The convenience of using the invention may be further enhanced by the addition of casters, allowing the unit to be repositioned easily.

DESCRIPTION OF THE DRAWINGS

The aforementioned, and other objects and features of the invention will be apparent from the following detailed description of specific embodiments thereof, when read in conjunction with the accompanying drawings, in which.

DETAILED DESCRIPTION OF THE INVENTION

Figure 1:
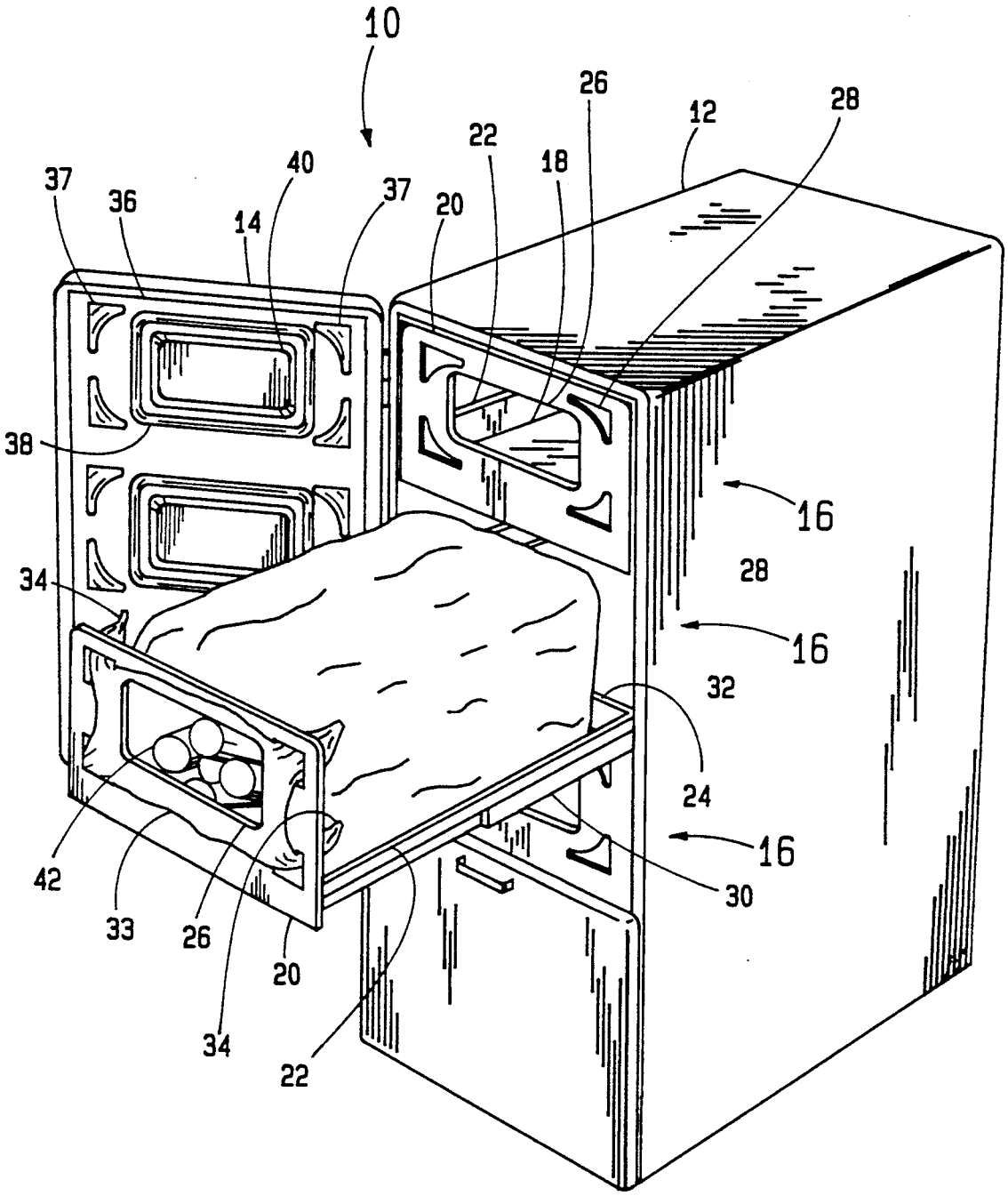
FIG. 1 is an overall view of a preferred embodiment of the invention showing a compartment in the unloading, or second position.

Now, turning to FIG. 1, wherein the construction and operation of a preferred embodiment 10 of the present invention is shown, we find a housing 12 with a hinged outer door 14. The outer door 14 acts as a cover for a plurality, in this case three, individual sliding compartments 16. Each compartment 16 comprises a bottom panel 18, a front panel 20, raised side edges 22 and a raised rear edge 24. Each front panel 20 has a substantially rectangular access hole 26 and four retaining holes 28, with the access hole 26 being located so as to be significantly above bottom panel 18. Adjacent to each side edge 22 is a slide mechanism 30 supporting compartment 16 for movement relative to housing 12. A flexible bag 32, which may be of plastic, paper or cloth construction, and is preferably a drawstring closure type, is unfolded along the bottom panel 18 with the open end 33 extending through access hole 26 and retained for the insertion of classified refuse. Open end edge segments 34 of flexible bag 32 are inserted through retaining holes 28 so that open end 33 is flattened against front panel 20. The outer door 14 is fitted with an inner facing 36 having raised portions 37 which register with retaining holes 28 to grip open end edge segments 34, and also gasket portion 38 which surrounds access hole 26 so as to hold flexible bag 32 as a sealed enclosure when outer door 14 is shut. Gasket portion 38 also holds open end 33 as classified material 42 is pushed into flexible bag 32. Separate access hole covers 40 may be provided in outer door 14 for individual access to compartments 16 when outer door 14 is closed. When outer door 14 is open, flexible bag 32 may be closed and tied shut. Then when compartment 16 is pulled out horizontally from housing 12, flexible bag 32 is made accessible and it may be freely removed without lifting by rolling it laterally over the side edge.

Figure 2:
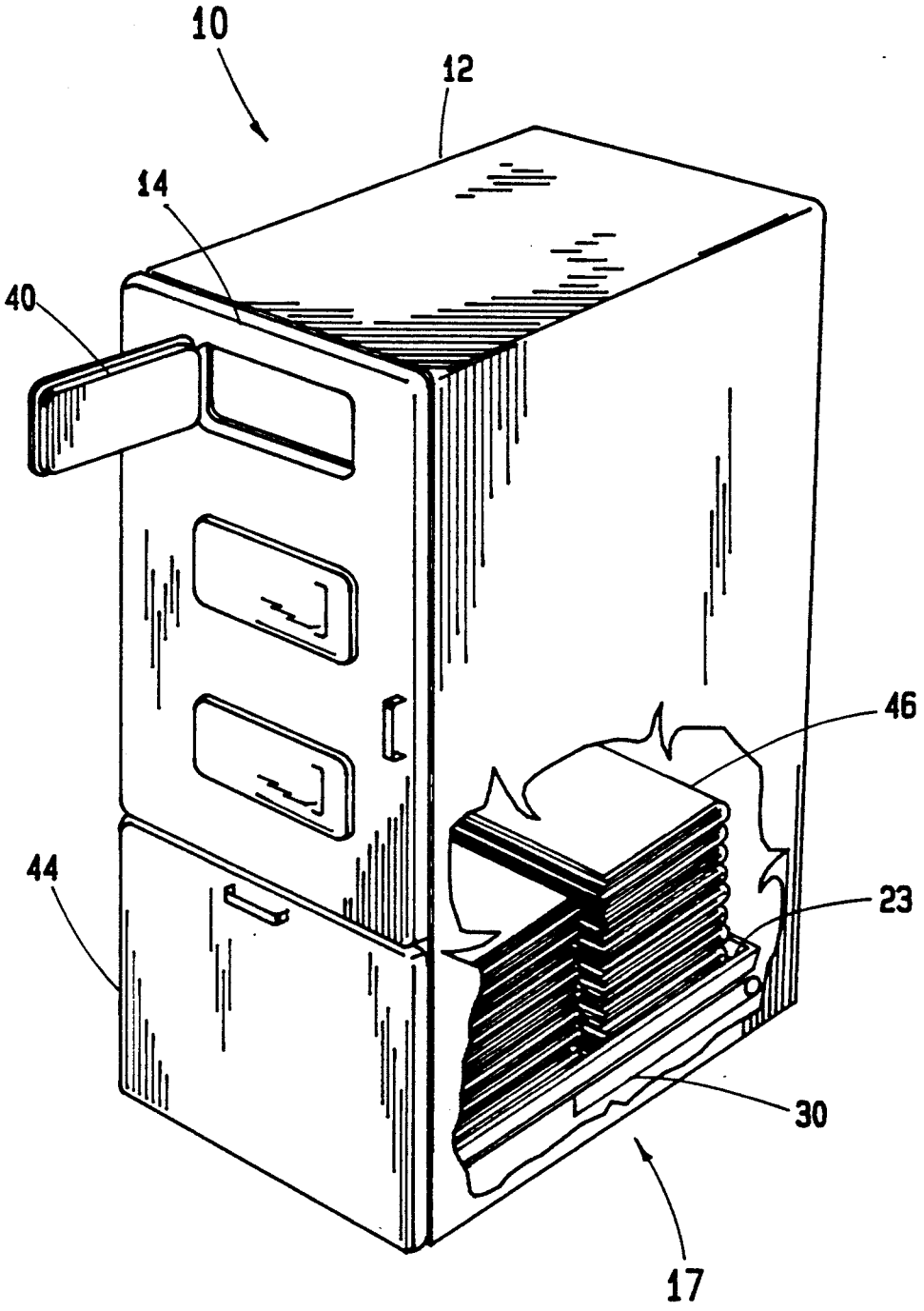
FIG. 2 is an overall view of the preferred embodiment of FIG. 1 with the outer door closed and one access door open and a lower compartment configured for newspaper bundling.

FIG. 2 shows the preferred embodiment 10 of FIG. 1 with the outer door 14 closed. The uppermost access hole cover 40 is shown to be open as when ready to receive material. The side of housing 12 is cut away to show newspapers 46 stacked inside of a second type of compartment 17. The side edges 23 are supported by slide mechanisms 30 in the manner of the side edges 22 of compartments 16. However, in this case, front panel 44 doubles as the external cover, and compartment 17 is pulled out when it is to receive material.

Figure 3:
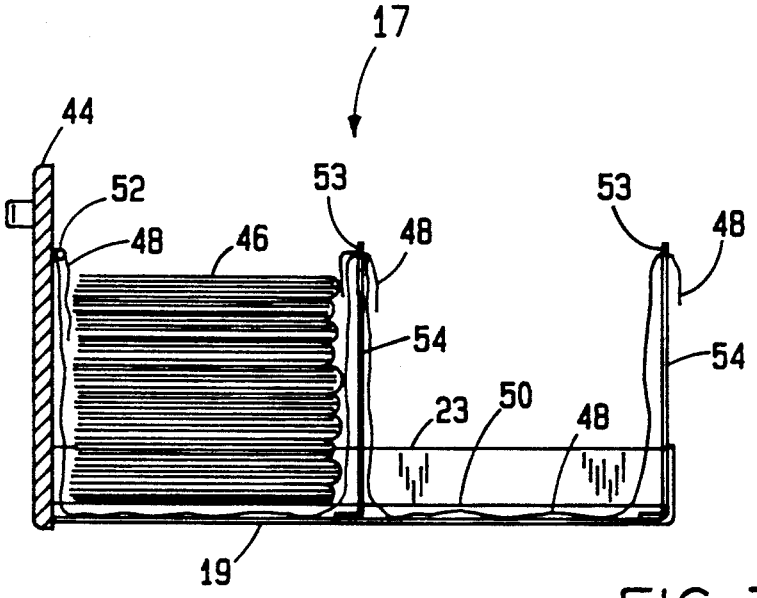
FIG. 3 is a cross section view of the lower compartment of FIG. 2 showing details of a provision for newspaper bundling.

FIG. 3 provides more detail on the manner in which compartment 17 is adapted to accept newspapers 46 for bundling. The bottom panel 19 is seen to include a groove 50 for placing tying elements 48, which may be cordage, wire or plastic ties, under stacks of newspaper 46. Tying element 48 is put in place first, and held in position by retaining eye 52 and slots 53 of flexible spring supports 54 as the newspapers 46 are accumulated. Tying elements 48 are then readily at hand to bind newspapers 46 into bundles for collection. If tying element 48 is not prepositioned, groove 50 serves as a conduit for passing it around the accumulated stack of newspaper 46.

Figure 4:
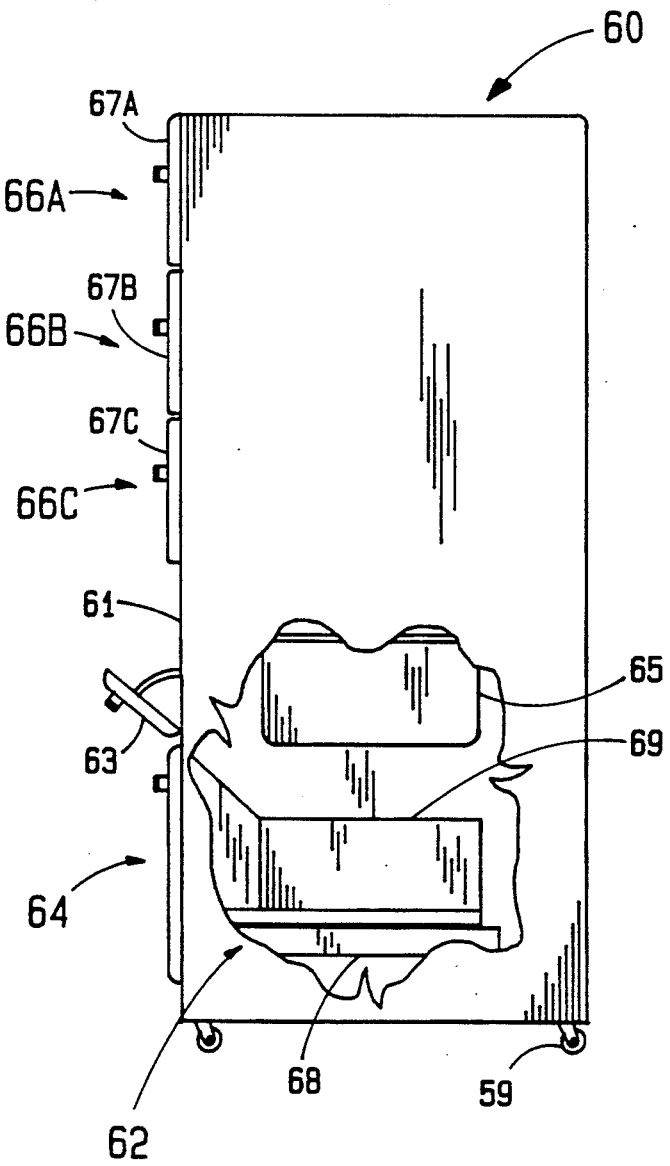
FIG. 4 shows the lower compartment of the preferred embodiment as configured for a waste compactor.

In FIG. 4 is shown an alternate embodiment 60 of the invention having a conventional trash compactor 62 installed in an enlarged compartment 64. The added space required by compartment 64 is provided by making outer housing 61 somewhat higher than would otherwise be the case, or by reducing the size or number of trash classification compartments 66. Here are shown door three such compartments, 66A, 66B and 66C covered by separate outer doors 67A, 67B and 67C. Trash door 63 is opened to insert trash into the compactor chamber 69, which may be lined, and is compacted by the lowering of ram 65. When chamber 69 is to be emptied for collection, slide mechanism 68 allows compartment 64 to be pulled out as has been described for compartments 16 and 17 in FIGS. 1 and 2. Outer housing 61 is shown to be mounted on optional casters 59 for added convenience.

Figure 6:
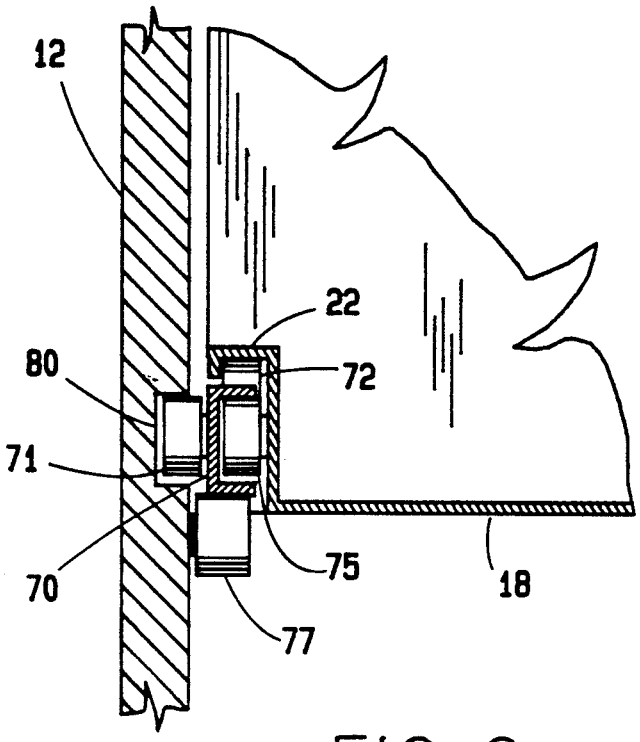
FIG. 6 is a view of the mechanism of FIG. 5 as from the direction of the arrows 6—6.
Figure 5:
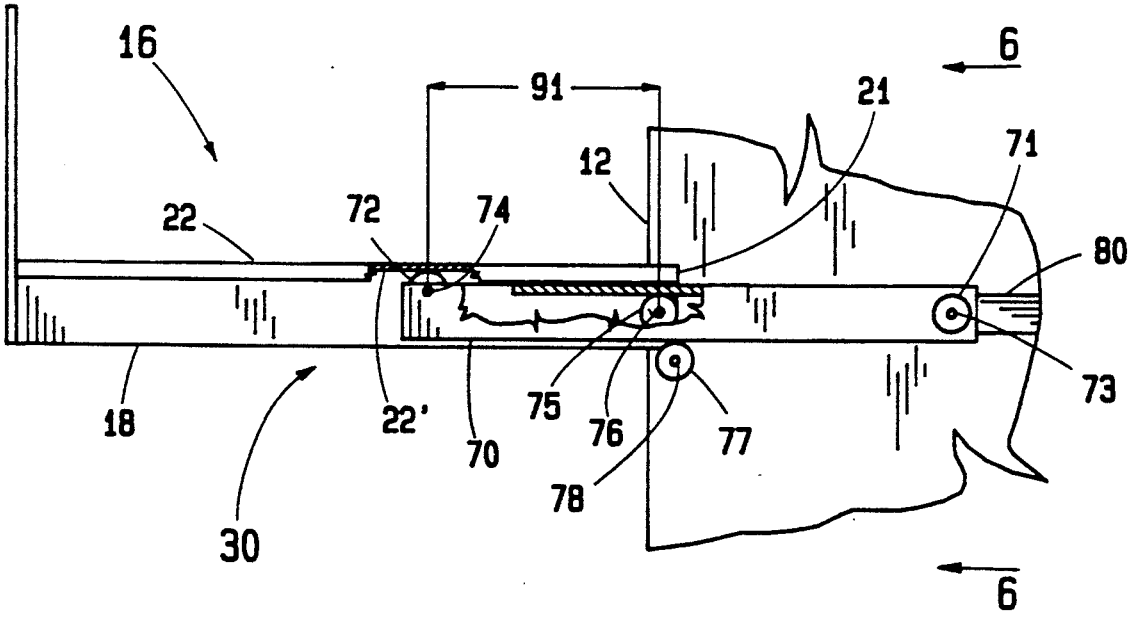
FIG. 5 is a detail view of a slide mechanism for compartment positioning and also shows how the compartment bottom panel may be sloped to facilitate bag filling.

The slide mechanism 30 is shown in greater detail in FIGS. 5 and 6, wherein is disclosed the construction and assembly of telescoping slide members 70, of each side of compartment 16. The slide members 70 have slide rollers 71 and side edge rollers 72 mounted at either end so as to rotate freely. Slide rollers 71, rotating on cantilevered shafts 73, engage with horizontal slots 80 at the inner surface of housing 12, while side edge rollers 72, which rotate on shafts 74, bear against the underside 22' of side edges 22. Compartment rollers 75, mounted adjacent the inner end 21 of side edges 22, rotate on shaft 76 and, working in conjunction with side edge rollers 72, support compartment 16 for movement on slide members 70. Slide members 70 are supported for movement relative to housing 12 by slide rollers 71 working in conjunction with bottom rollers 77, mounted on shafts 78 to the inside of housing 12, and bear against the underside of slide members 70. Thus, compartment 16 can be moved from a first position, entirely within housing 12, to a second position, essentially outside the perimeter of housing 12, so as to permit easy unloading. In this second position, the weight of the extended compartment 16 is supported by the contact force couple working on moment arm 91.

Figure 7:
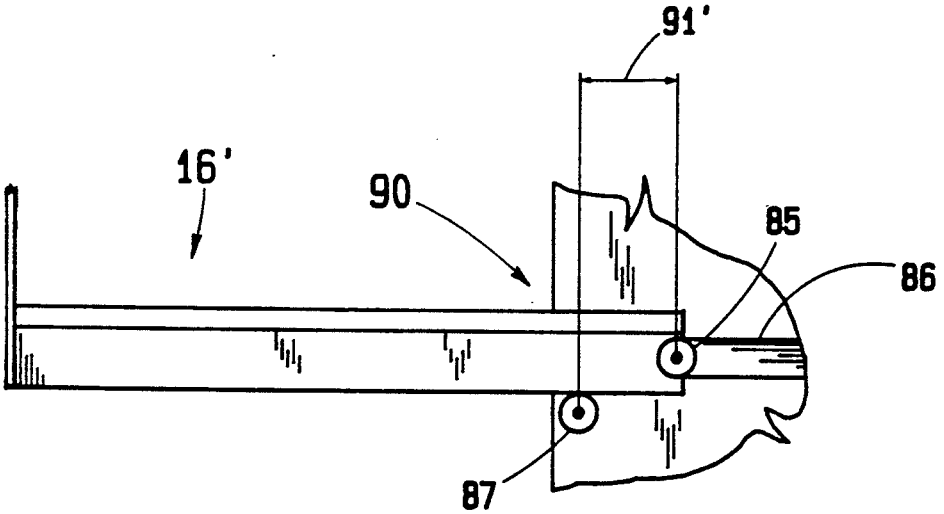
FIG. 7 is a detail view of an alternate slide mechanism.

FIG. 7 shows one alternate compartment slide mechanism 90 wherein compartment rollers 85 engage directly with housing slots 86 and thereby, working in conjunction with bottom rollers 87, support compartment 16' for movement in somewhat the manner of the previously described slide mechanism 30 of compartment 16. As compartment 16' approaches the second, extended position of compartment 16 however, the rollers 85 and 87 work on a severely reduced moment arm 91', causing instability and excessive contact forces. Thus, slide mechanism 90 can not allow compartment 16' to extend as fully for unloading as can compartment 16 with slide mechanism 30, and is therefore less desirable, albeit workable. A slide mechanism may also take the form of a recirculating ball linear bearing, as is well known to the mechanical arts, or friction reducing materials may be used to allow the use of sliding contact parts instead of rollers.

Achieving the stated objectives of convenience and ease of use while maximizing capacity may entail certain compromises. The unit cannot be so high that it is difficult to unload, and the normal range of stature must be considered. It is also recognized that the effort of urging materials into a fully horizontal bag may be facilitated by sloping the bottom panel slightly, at the expense of somewhat diminished capacity.

Figure 8:
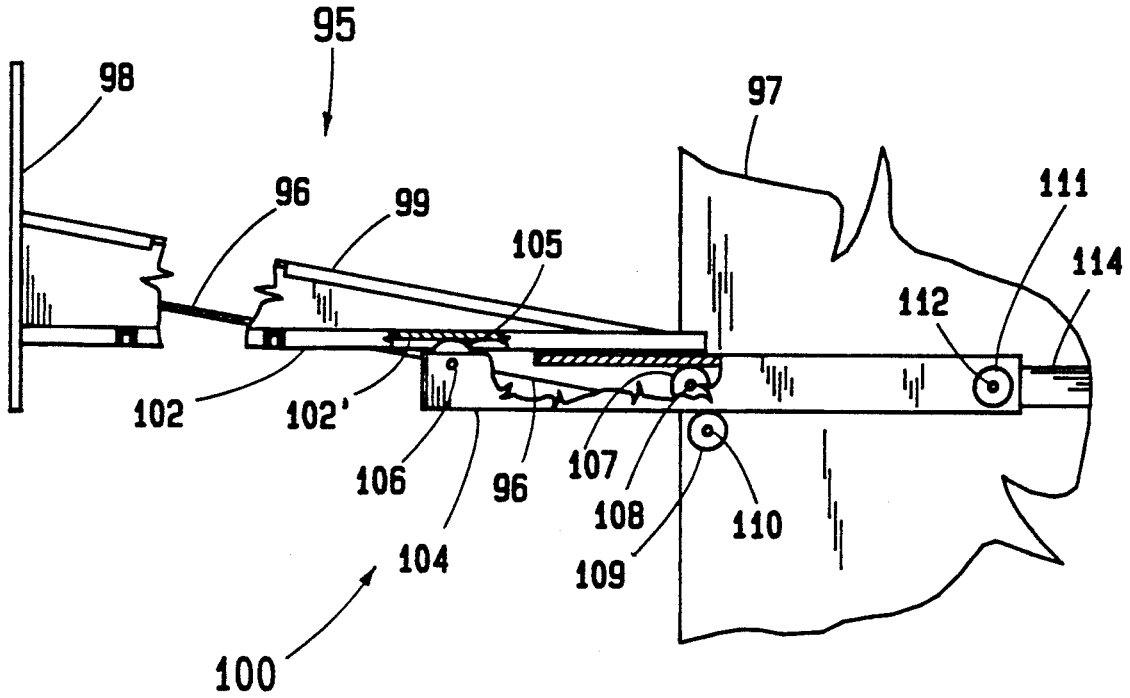
FIG. 8 is a view showing an optionally inclined bottom panel.

FIG. 8 shows alternate compartment 95 with front panel 98 and a bottom panel 96 sloped slightly to facilitate loading. Slide mechanism 100 is much the same as the slide mechanism 30 shown in FIGS. 5 and 6. Side edges 99, on either side of compartment 95 are inclined to match bottom panel 96 and also include horizontal slide channels 102. Telescoping slide members 104, also on each side, have slide rollers 111 and side channel rollers 105 mounted at either end so as to rotate freely. Slide rollers 111, rotating on cantilevered shafts 112, engage with horizontal slots 114 at the inner surface of housing 97, while side channel rollers 105, which rotate on shafts 106, bear against the underside 102' of side channels 102. Compartment rollers 107, mounted adjacent the inner end of side edges 99, rotate on shafts 108 and, working in conjunction with side edge rollers 105, support compartment 95 for movement on slide members 104. Slide members 104 are supported for movement relative to housing 97 by slide rollers 111 working in conjunction with bottom rollers 109, which rotate on shafts 110, mounted to the inner surface of housing 97, and bear against the underside of slide members 104. Thus, alternate compartment 95 can be moved from a first position, entirely within outer housing 97, to a second position essentially outside the perimeter of outer housing 97, so as to permit easy unloading.

It will be understood that the invention is not limited to the disclosed embodiments, but is capable of rearrangement, modification and substitution of parts and elements without departing from the spirit of the invention.

Having thus described my invention, I claim:

1. An appliance for separating and holding classified refuse having an outer housing and a plurality of substantially horizontal, vertically arrayed compartments therein comprising:

a compartment bottom panel having a front edge, a rear edge, and two side edges;

a flexible bag having a closed end and an open end and supported by said compartment bottom panel so that said closed end is opposed to said open end on a substantially horizontal axis;

a compartment front panel attached in a substantially vertical plane to said compartment bottom panel adjacent said front edge, said compartment front panel including means for receiving said open end, inserting refuse therein and allowing said open end to be closed for removal of said bag;

slide means for mounting and supporting said compartment bottom panel relative to said housing in horizontal translation between a first position fully within said housing and a second position extending outside of said housing so as to allow said bag to be freely removed from said compartment bottom panel; and door means for enclosing said compartment front panel, in said first position, within said outer housing.

2. An appliance for separating and holding classified refuse having an outer housing and a plurality of substantially horizontal, vertically arrayed compartments according to claim 1 wherein said compartment front panel further comprises bag retaining means for holding said open end to receive refuse.

3. An appliance for separating and holding classified refuse having an outer housing and a plurality of substantially horizontal, vertically arrayed compartments therein according to claim 2 wherein said bag retaining means comprises:

said compartment front panel having a plurality of retaining holes therein to receive gathered edge segments of said open end; and said door means having a plurality of raised portions to cooperate with said retaining holes in holding said gathered edge segments in place when closed.

4. An appliance for separating and holding classified refuse having an outer housing and a plurality of substantially horizontal, vertically arrayed compartments therein according to claim 2 wherein said bag retaining means comprises:

a gasket portion fitted to said door means so as to press said open end against said compartment front panel.

5. An appliance for separating and holding classified refuse having an outer housing and a plurality of substantially horizontal, vertically arrayed compartments therein according to claim 1 wherein said slide means further comprises friction reducing means for facilitating movement between said first and second positions.

6. An appliance for separating and holding classified refuse having an outer housing and a plurality of substantially horizontal, vertically arrayed compartments therein according to claim 5 wherein said friction reducing means comprises:

first friction reducing means adjacent said front panel in said first position for movably supporting said compartment; and second friction reducing means adjacent said rear edge in said first position for cooperating with said first friction reducing means in supporting said compartment.

7. An appliance for separating and holding classified refuse having an outer housing and a plurality of substantially horizontal, vertically arrayed compartments therein according to claim 1 wherein said door means comprises:

a hinged outer door covering said compartment front panel in said compartment first position; and means for sealing said open end.

8. An appliance for separating and holding classified refuse having an outer housing and a plurality of substantially horizontal, vertically arrayed compartments therein according to claim 7 wherein said sealing means comprises:

a gasket portion fitted to the inner face of said closed outer door so as to press said open end against said compartment front panel.

9. An appliance for separating and holding classified refuse having an outer housing and a plurality of substantially horizontal, vertically arrayed compartments therein according to claim 1 wherein said bottom panel is inclined downwardly away from said front panel.

10. An appliance for separating and holding classified refuse having an outer housing and a plurality of substantially horizontal, vertically arrayed compartments therein according to claim 1 and further comprising;

raised side edges joined to said compartment front panel; and a raised rear edge joined to said side edges so that said compartment front panel, said side edges, said rear edge and said compartment bottom panel form a tray capable of liquid retention.

11. An appliance for separating and holding classified refuse having an outer housing and a plurality of vertically arrayed compartments therein comprising:

two or more first compartments having a substantially horizontal bottom panel with side and rear edges and a substantially vertical front panel;

a flexible bag having a closed end and an open end and supported by said bottom panel so that said closed end is opposed to said open end on a substantially horizontal axis;

said front panel including an open access hole adapted to receive said open end;

slide means for mounting and supporting said bottom panel relative to said housing in horizontal translation between a first position fully within said housing and a second position extending outside of said housing so as to allow said bag to be freely removed from said bottom panel by the rolling thereof over said side edge without lifting; and an outer door enclosing within said outer housing said compartment front panels in said first position.

12. An appliance for separating and holding classified refuse having an outer housing and vertically arrayed compartments therein according to claim 11 and further comprising:

a second compartment adapted to accept stacks of newspaper and having a substantially horizontal second bottom panel with side and rear edges and a substantially vertical second front panel;

slide means for mounting and supporting said second compartment in translation between a first position fully within said housing and a second position extending outside of said housing so as to allow access for said stacks of newspaper to be placed in said second compartment and freely removed therefrom.

13. An appliance for separating and holding classified refuse having an outer housing and vertically arrayed compartments therein according to claim 11 and further comprising:

a third compartment adapted to include a trash compactor;

a door for inserting trash into said compactor for compacting; and slide means for mounting and supporting said third compartment in translation between a first position fully within said housing and a second position extending outside of said housing so as to allow trash to be removed from said trash compactor.

14. A method for classifying and handling refuse in a confined area with minimal dedicated floorspace comprising the steps of:

arranging and supporting flexible bags having an open end and a closed end in a vertical array so that the open ends are opposed on a substantially horizontal axis to the closed ends thereof;

retaining the open ends in position to receive classified refuse inserted into the flexible bags;

covering the open ends when awaiting the insertion of classified refuse;

uncovering the open ends for the insertion of classified refuse;

uncovering the open ends for closing thereof so as to close the flexible bags in preparation for collection of classified refuse;

individually translating the closed flexible bags along said horizontal axis to an accessible position; and rolling the closed flexible bags laterally, without any otherwise lifting thereof, for free removal from the vertical array and subsequent collection.

* * * * *